US006457326B1

(12) United States Patent
Serpente et al.

(10) Patent No.: US 6,457,326 B1
(45) Date of Patent: Oct. 1, 2002

(54) PURGE SYSTEM FOR ABSORPTION UNIT

(75) Inventors: Christopher P. Serpente, Liverpool, NY (US); Darren Sheehan, East Syracuse, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/886,746

(22) Filed: Jun. 21, 2001

(51) Int. Cl.[7] ..... F25B 43/04
(52) U.S. Cl. ..... 62/475; 62/141; 62/483
(58) Field of Search ..... 62/147, 195, 475, 62/482, 483, 324.2

(56) References Cited

U.S. PATENT DOCUMENTS 4,984,431 A * 1/1991 Mount et al. ..... 62/85
5,065,594 A * 11/1991 Yo ..... 62/195
5,369,959 A * 12/1994 Pfefferle et al. ..... 62/195
6,047,559 A 4/2000 Tanaka et al.
6,055,821 A * 5/2000 Song et al. ..... 62/195
6,067,807 A 5/2000 Reimann

FOREIGN PATENT DOCUMENTS

JP 4-32081 A * 11/1992 ..... 62/475

* cited by examiner

*Primary Examiner*—Denise L. Esquivel
*Assistant Examiner*—Melvin Jones
(74) *Attorney, Agent, or Firm*—Wall Marjama & Bilinski

(57) ABSTRACT

An absorption refrigeration unit having a purge system that will sense when the discharge pressure of the solution pump becomes subatmospheric and will automatically increase the speed of the pump to bring the discharge pressure up to a desired level above atmospheric pressure so that a purging cycle can be achieved. The system further monitors the generation solution level and interrupts the purging cycle in the event the solution reaches an undesirable level.

14 Claims, 2 Drawing Sheets

PURGE SYSTEM FOR ABSORPTION UNIT

FIELD OF THE INVENTION

This invention relates generally to an absorption refrigeration unit and, more specifically, to a purge system for use in an absorption unit.

BACKGROUND OF THE INVENTION

Typically, non-condensable gas that is generated in an absorption refrigeration system is removed by means of an automatic purge system. Non-condensable gases can degrade performance and may be a symptom of a reliability problem, such as corrosion or an air leak.

In some absorption units, solution from the solution pump is passed through an eductor where it is mixed with non-condensables drawn from the absorber. The mixture is then discharged into the condenser. Here, the non-condensables are separated from the solution and are drawn off by means of a second eductor where they are again entrained in solution. The mixture is then discharged into a purge tank where the non-condensables are collected in the top section of the tank and the solution returns to the absorber by means of a return line.

As the tank fills with non-condensables, the solution in the tank is depressed to a point where the tank must be purged. Purging is accomplished by closing a valve in the solution return line and the purge valve in the condenser supply line going to the second eductor. Solution is now forced into the purge tank by the solution pump causing the non-condensables in the purge tank to be compressed. When a sufficient amount of non-condensables have been collected, the exhaust valve in the tank discharge line is opened to allow the non-condensable gas to be bled from the tank into the atmosphere.

As should be evident, in this type of purge system the solution pump must be able to deliver solution to the purge tank at a pressure that is above atmospheric pressure. Many absorption units employ variable speed absorption pumps that oftentimes operate at reduced speeds depending upon the demand on the system, and thus cannot deliver solution at above atmospheric pressure during a purge cycle.

SUMMARY OF THE INVENTION

It is, therefore, a primary object of the present invention to improve absorption refrigeration units.

It is a further object of the present invention to improve purge systems employed in absorption refrigeration units.

A still further object of the present invention is to purge non-condensable gases from an absorption refrigeration unit during periods when the solution pump is operating at a reduced speed at which the pumps discharge pressure is below the existing atmospheric pressure.

These and other objects of the present invention are obtained in an absorption refrigeration unit, having an improved system for purging non-condensable gases from the unit during periods when the solution pump is operating with a discharge pressure below atmospheric pressure. An eductor is connected to the discharge side of the solution pump and to the top section of the absorber so that non-condensable gases collected in the absorber are drawn from the absorber and are entrained in the solution. The mixture leaving the eductor is discharged into a purge tank where the non-condensable gases are collected in the top section of the tank over solution that settles in the bottom of the tank. The collected solution is returned to the absorber as the amount of non-condensables increase in the tank. At the start of a purge cycle, the discharge pressure of the solution pump is sensed and when the pressure is below atmospheric pressure, the speed of the pump is increased to bring the discharge pressure up to a desired level that is above atmospheric pressure. A control valve in the return line from the purge tank and a second control valve in the non-condensable input line to the eductor are then closed wherein solution from the pump is forced into the tank to compress the non-condensables collected in the top of the tank. The compressed non-condensables are then exhausted from the tank via an exhaust line.

BRIEF DESCRIPTION OF THE DRAWINGS

For a further understanding of these and objects of the invention, reference will be made to the following detailed description of the invention which is to be read in connection with the accompanying drawing, wherein.

DETAILED DESCRIPTION OF THE INVENTION

Figure 1:
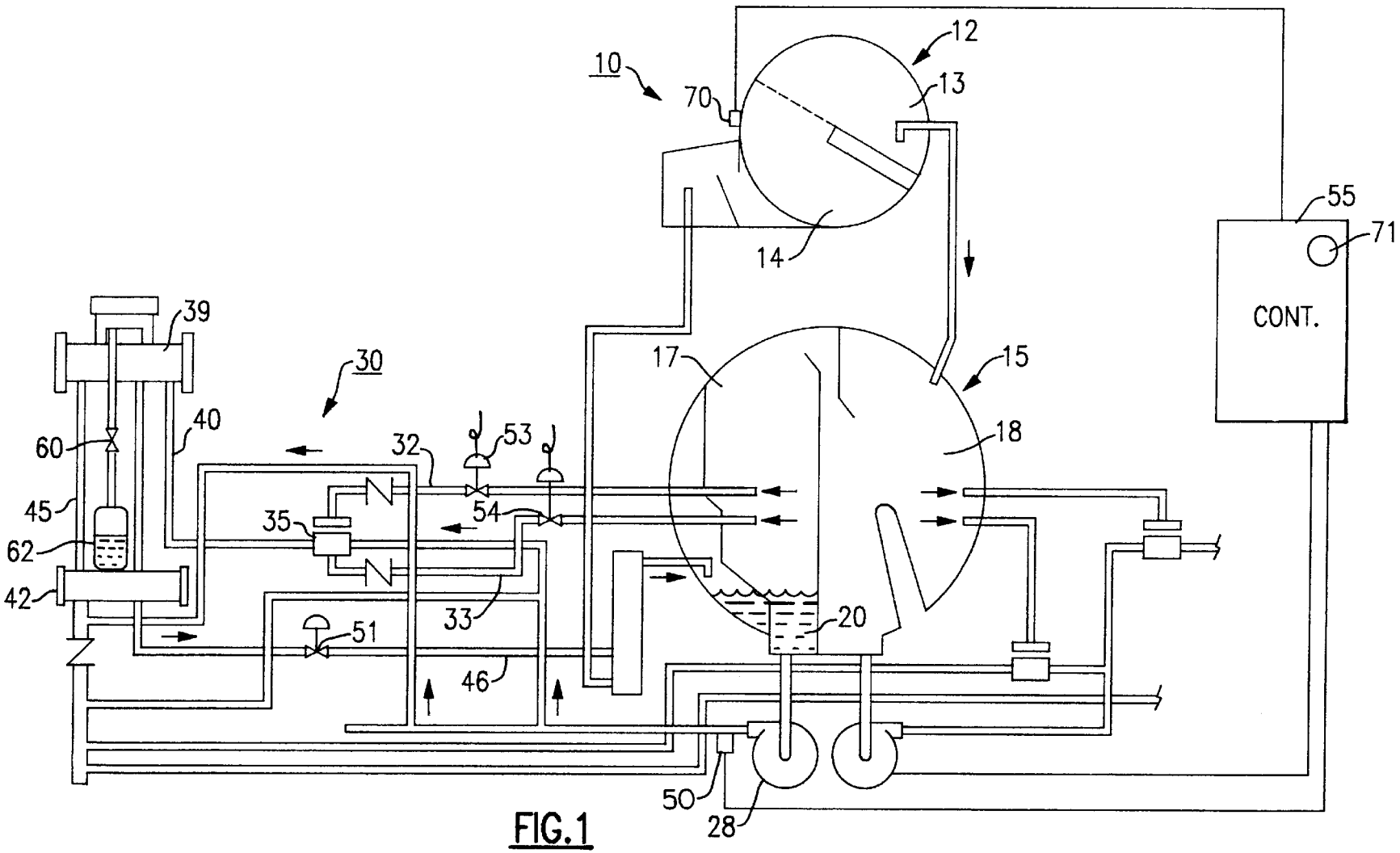
FIG. 1 is a schematic representation of an absorption refrigeration unit embodying the improved purge system of the present invention.

Turning initially to FIG. 1, there is shown a single stage absorption refrigeration unit, generally referenced 10, that embodies the purge system of the present invention. The unit includes an upper cylindrical shell 12 that houses the condenser 13 and a single stage generator 14. A second lower cylindrical shell 15 is located beneath the upper shell and houses the unit absorber 17 and evaporator 18. The four main sections of the unit are interconnected in a conventional manner to provide either cooling or heating, depending on the selected mode of operation. The operation of a single stage absorption unit is well known in the art and will not be further described herein. It should be noted, however, that although the invention will be described with specific reference to a single stage machine, it can be employed in association with multiple stage units equally as well without departing from the teachings of the present invention.

During a cooling cycle, weak solution 20 which is rich in refrigerant is drawn from the bottom of the absorber by means of a solution pump 28. Although not shown, the weak solution is passed through at least one solution heat exchanger and delivered into the generator 14 where it is heated. Refrigerant vapors produced in the generator are passed to the condenser and the now strong solution in the generator is returned to the absorber. Condensed refrigerant is gravity fed to the evaporator where the cooling process takes place. The evaporated refrigerant is then passed back to the absorber. In the absorber, the vapors are combined with the strong absorbent solution to produce a weak solution and the cycle is repeated. Heat developed in the absorber is removed from the unit by suitable means, however, non-condensable gases produced in the process collect in the absorber over the solution.

As noted above, most absorption machines have some type of system for purging these non-condensable from the units. However, many of these systems cannot operate when the solution pump is running at a low speed where the discharge pressure of the pump is below atmospheric pressure. As will be explained in detail below, the purge system of the present invention is capable of determining when the discharge pressure of the pump is at, or drops below, atmospheric pressure, increasing the discharge pressure of the pump, if necessary, and institutes corrective action to insure that the purge cycle will be carried out without interruption of the machine cycle.

Figure 2:
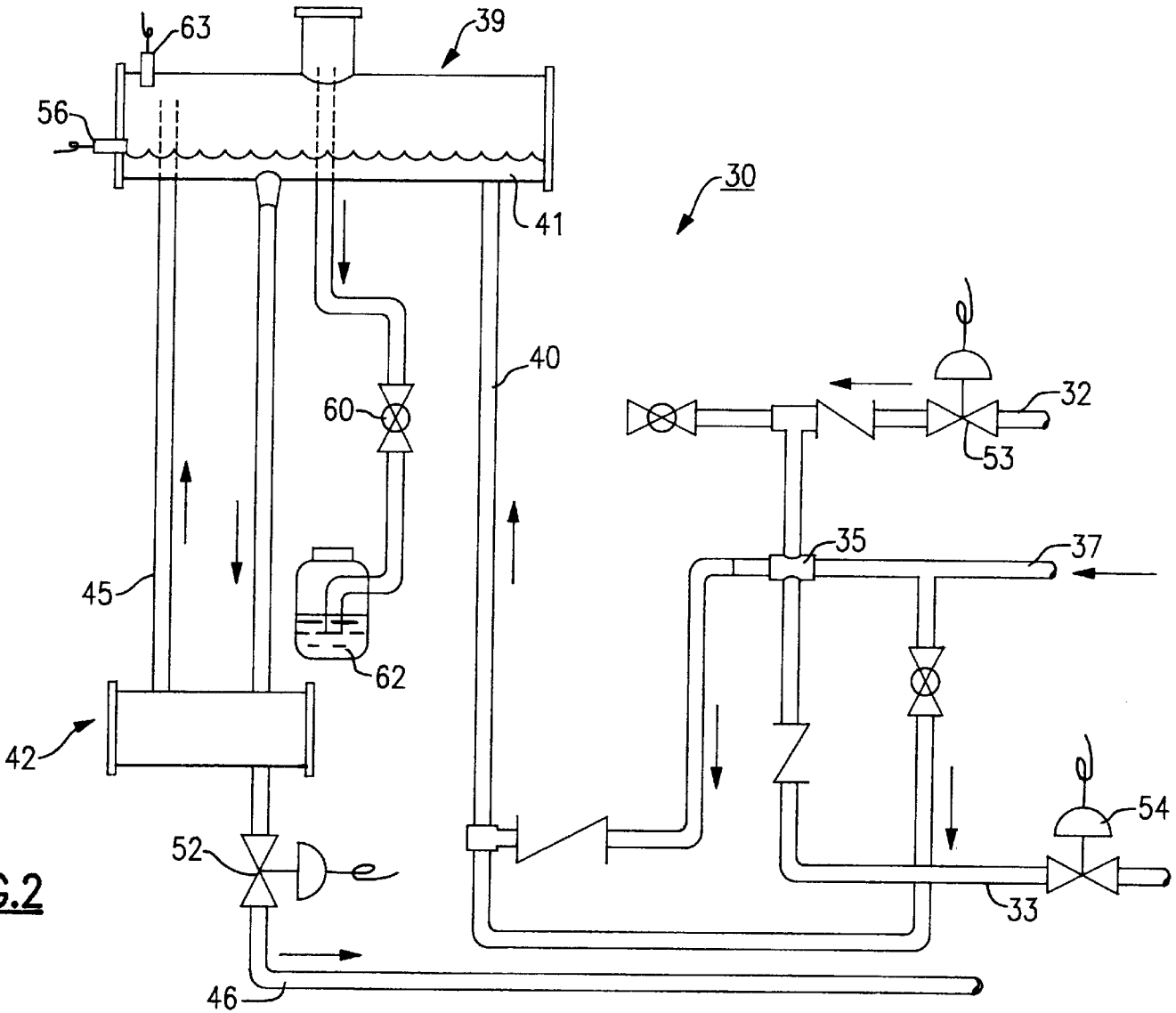
FIG. 2 is an enlarged partial elevation showing the purge system employed in the absorption refrigeration unit of FIG. 1.

With further reference to FIG. 2, the present purge system 30 is shown in greater detail. A pair of purge lines 32 and 33 are arranged to deliver non-condensable gases from the absorber to either side of eductor 35. A solution line 37, in turn, carries solution from the discharge side of the solution pump to the inlet of the eductor nozzle. In the eductor the non-condensable gases are entrained within the solution and the resulting mixture delivered into the purge tank 39 via the mixture inlet line 40. In the tank, the non-condensables come out of the mixture and are collected in the top section of the tank over the solution 41.

Under normal machine operations the solution collected in the purge tank is gravity fed into a separation tank 42 where any non-condensables left in the solution are released from the solution and are passed back into the upper section of the purge tank by means of gas return line 45. The solution collected in the separating tank is, in turn, passed back to the absorber by means of the solution return line 46.

As the purge tank fills with non-condensables, the solution level in the purge tank is depressed to a predetermined level near the bottom of the tank at which point a signal is sent to the machine controller 55 (FIG. 1) indicating a purge cycle should be initiated. Various other means, including the pressure in the purge tank, could be used to initiate a purge cycle rather than the level of solution in the tank.

A pressure sensor 50 (FIG. 1) is placed in the discharge port of the solution pump which provides discharge pressure data to a processor contained in the unit controller 55. The discharge pressure is compared to the existing atmospheric pressure to determine if the pump discharge pressure is above or below atmospheric pressure. If the discharge pressure is subatmospheric, the program algorithm instructs the pump to increase its speed until such time as the discharge pressure is raised to a desired operating level, that is, a level above atmospheric pressure and the purging operation proceeds in a normal sequence.

Purge evacuation of the tank is begun by closing the control valve 51 in the solution return line 46 extending between the separation tank and the absorber. At the same time, the control valves 53 and 54 in the purge lines 32 and 33 are closed. The control valves are remotely controlled by the unit controller 55 (FIG. 1) upon receipt of a purge initiation signal from level sensor 56 associated with the purge tank. The valves in this system could be automatic or manually operated.

When the non-condensable gas pressure reaches a given level, the purge valve 60 is opened and the gas in the purge tank compressed by the rising solution is exhausted into a purge bottle 62. A second gas sensor 63 is mounted in the upper section of the purge tank that tells the processor when the tank is empty of non-condensables whereupon the control valves are recycled and normal machine operations are resumed.

If during the purge sequence the solution pump speed is increased as described above to maintain a desired discharge pressure, the generator solution level may also increase and the machine equilibrium, therefore, may be disturbed. At such time, when the load demand on the system is low, the generator pressure is correspondingly low resulting in a reduced flow out of the generator. Accordingly, any increase in the solution pump speed may force more solution into the generator than can be removed at the reduced operating level and the generator may become flooded. As the generator solution level increases there is a danger that the refrigerant leaving the generator can become contaminated with solution. A level sensor 70 (FIG. 1) is placed in the generator and arranged to detect when a potentially dangerous high solution level is reached. A high level signal is then sent to the controller whereupon the solution pump speed is reduced and the control valves are cycled to terminate the purge sequence before any problem to the system results.

A warning light 71 is provided on the controller which tells the operator that the purge sequence has been terminated. A sufficient time delay in the sequence is provided to allow the generator solution level to decrease to a desired level whereupon the sequence is reinstituted. The control valves associated with the purge procedure are cycled automatically by the processor any time the discharge pressure of the solution pump becomes subatmospheric. When the purge sequence is completed, the algorithm cycles the control valves to the normal operation position and the solution pump speed is returned to the normal algorithm control.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. Apparatus for purging non-condensable gases from an absorption refrigeration unit containing a variable speed solution pump, said apparatus including, a solution inlet line for delivering a mixture of solution and non-condensable gases from the unit into a purge tank so that the solution is collected in the bottom of the tank and non-condensable gases are collected in the top of said tank, sensing means for monitoring the solution pump discharge pressure, and control means for comparing the discharge pressure of said solution pump and atmospheric pressure and closing all inlet and outlet lines to said purge tank with the exception of said solution inlet line in the event the discharge pressure of the pump is at or below atmospheric pressure whereby solution from said pump is forced into said purge tank to compress the non-condensable gases in said tank.

2. The apparatus of claim 1 that further includes eductor means for mixing non-condensable gases from said unit with solution discharged from said solution pump prior to delivering said mixture to said purge tanks.

3. The apparatus of claim 1 that further includes an exhaust line connected to said purge tank for exhausting non-condensable gases from said tank and a gas exhaust control valve mounted in said exhaust line.

4. The apparatus of claim 3 that further includes means for cycling said gas exhaust control valve to exhaust said compressed gases from said purge tank.

5. The apparatus of claim 1 that includes sensing means for providing an output signal to the control means for terminating a purge sequence when the solution level in the unit generator reaches a given level.

6. The apparatus of claim 1 that further includes a separator tank connected to the bottom of said purge tank for collecting solution from said purge tank and further separating non-condensable gases from said collected solution.

7. The apparatus of claim 5 wherein said sensing means is a level sensor.

8. A method of purging non-condensable gases from a purge tank of an absorption refrigeration unit during periods when the discharge pressure of the unit solution pump is at or below atmospheric pressure including the steps of sensing the discharge pressure of the solution pump and comparing the sensed pressure to atmospheric pressure, increasing the solution pump speed in the event the sensed discharge pressure is at or below atmospheric pressure to bring the discharge pressure to a predetermined level that is above atmospheric pressure.

closing all inlet and outlet lines servicing said purge tank except a solution inlet line to said purge tank wherein solution from said solution pump is forced into said purge tank to compress non-condensable gases previously collected in said tank, and exhausting the compressed non-condensable gases from said purge tank from said purge tank.

9. The method of claim 8 that includes the further step of mixing within at least one eductor non-condensable gases produced within said refrigeration unit with solution discharged from said solution pump and delivering said mixture from said at least one eductor to said purge tank through said solution inlet line.

10. The method of claim 8 wherein a solution return line from the purge tank is closed in the event the discharge pressure of the solution pump is at or below atmospheric pressure.

11. The method of claim 8 that further includes the steps of sensing the solution level in the unit generator and interrupting the purge cycle when the solution level in the generator reaches a given level.

12. The method of claim 11 that includes the further step of restarting the purge cycle when the solution in the generator returns to a desired operating level.

13. The method of claim 8 that further includes the step of sensing the non-condensable gas pressure in said purge tank and opening an exhaust control valve in the purge tank exhaust line.

14. The method of claim 8 that includes the steps of mounting remotely controlled valves in said inlet or outlet line of said purge tank and cycling the valves remotely from a unit controller to start and terminate a purge sequence.

* * * * *